US009896773B2

(12) United States Patent
Vabishchevich et al.

(10) Patent No.: US 9,896,773 B2
(45) Date of Patent: Feb. 20, 2018

(54) BUSBAR ARRANGEMENT FOR ALUMINUM ELECTROLYSERS WITH A LONGITUDINAL POSITION

(75) Inventors: Petr Nikolaevich Vabishchevich, Moscow (RU); Aleksandr Olegovich Gusev, Krasnoyarsk (RU); Aleksey Gennad'evich Burtsev, Krasnoyarsk (RU)

(73) Assignee: UNITED COMPANY RUSAL ENGINEERING AND TECHNOLOGY CENTRE LLC, G. Krasnoyarsk (RU)

( * ) Notice: Subject to any disclaimer, the term of this patent is extended or adjusted under 35 U.S.C. 154(b) by 220 days.

(21) Appl. No.: 14/415,092

(22) PCT Filed: Jul. 17, 2012

(86) PCT No.: PCT/RU2012/000572

§ 371 (c)(1),
(2), (4) Date: Jan. 15, 2015

(87) PCT Pub. No.: WO2014/014373

PCT Pub. Date: Jan. 23, 2014

(65) Prior Publication Data

US 2015/0218718 A1 Aug. 6, 2015

(51) Int. Cl.
*C25C 3/16* (2006.01)
*C25B 9/04* (2006.01)

(52) U.S. Cl.
CPC . *C25B 9/04* (2013.01); *C25C 3/16* (2013.01)

(58) Field of Classification Search
CPC ..... C25C 3/16; C25B 9/04
See application file for complete search history.

(56) References Cited

U.S. PATENT DOCUMENTS 3,616,317 A 10/1971 McLellan et al.
4,132,621 A 1/1979 Morel et al.
(Continued)

FOREIGN PATENT DOCUMENTS

CN 101857960 10/2010
CN 102534682 7/2012
(Continued)

*Primary Examiner* — Ciel P Thomas
(74) *Attorney, Agent, or Firm* — Hogan Lovells US LLP

(57) ABSTRACT

The invention relates to a busbar arrangement for heavy-duty aluminum electrolyzers when said electrolyzers have a longitudinal position. The busbar arrangement comprises anode busbars, risers and cathode rods, which are divided into groups, each of which is connected to separate cathode busbars, wherein the cathode busbars for the groups of rods closest to the input end of the preceding electrolyzer are connected to the risers positioned at the input end of the following electrolyzer, and the remaining groups of cathode rods are connected to the risers at the output end of the following electrolyzer. The cathode busbars for the groups of rods closest to the input end of the preceding electrolyzer are positioned beneath the base of the preceding electrolyzer, and the cathode busbars of the remaining groups of rods are positioned beneath the base of the preceding and the following electrolyzers or of the preceeding and following electrolyzers and along the cathode sheath on the front face side of the following electrolyzer. The risers at the input end of the following electrolyzer are mounted with an offset towards the center of the electrolyzer relative to the risers at the output end of the following electrolyzer. A high degree of compensation of electromagnetic forces in the melt is achieved by virtue of optimization of the configuration of the magnetic field in the electrolyzer bath and a reduction in the vertical magnetic field.

3 Claims, 3 Drawing Sheets

(56) References Cited

U.S. PATENT DOCUMENTS

| | | | | |
|---|---|---|---|---|
| 5,830,335 | A | 11/1998 | Antille | |
| 2008/0078674 | A1* | 4/2008 | Platonov | C25C 3/16<br>204/279 |

FOREIGN PATENT DOCUMENTS

| | | |
|---|---|---|
| RU | 2170290 | 7/2001 |
| RU | 2281989 | 8/2006 |
| RU | 2282681 | 8/2006 |
| RU | 2328555 | 7/2008 |
| RU | 2328556 | 7/2008 |
| RU | 2339742 | 11/2008 |

* cited by examiner

BUSBAR ARRANGEMENT FOR ALUMINUM ELECTROLYSERS WITH A LONGITUDINAL POSITION

This application is a U.S. National Phase under 35 U.S.C. § 371 of International Application PCT/RU2012/000572, filed on Jul. 17, 2012. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

The invention relates to non-ferrous metallurgy, in particular, to the electrolytic reduction of aluminum in reduction cells connected to each other in series.

Cells are connected to each other by means of a system of electrically-conductive busbars, one of the main requirements of which is providing an optimal magnetic field in the melt which has a minimal negative impact on the technological process.

Magnetic fields, both of the cell itself and its neighboring operating cells, have a significant impact on the magnetohydrodynamic and energy characteristics of the aluminum reduction cell.

Exposure of the cathode metal and the bath to electromagnetic fields leads to deformations of the surface of the metal in the form of undulations and heavings, which leads to cell operation destabilization and reduces the technical and economic indicators of the reduction process.

The basic requirements for an efficiently operating busbar are as follows:

- minimization and symmetry of the transverse component of the magnetic induction, By; and
- minimization, symmetry and sign alternation with respect to the longitudinal and transverse axes of the vertical component of the magnetic induction, Bz.

Meeting these requirements leads to a decrease in the circulation rate of the melt, a decrease in the magnitude of heavings and stabilization of surface disturbances of the metal-bath interface, and stabilization of disturbances.

A busbar is known for high amperage aluminum reduction cells longitudinally arranged in a housing, that consists of anode buses, risers, and collector bars that are divided into groups. Each group is connected to an individual stack of cathode buses. The stacks of cathode buses of the groups of collector bars closest to the input end of the cathode shell are connected to the risers located at the input end, while the remaining groups of collector bars are connected to the risers located along the sides of the cathode shell of the following cell (USSR Patent No. 738518, C 25 C 316, 1978).

The above art does not provide an optimal magnetic field configuration for cells longitudinally arranged in two-rows in the housing due to the fact that the vertical component of the magnetic field from the neighboring row of cells is not compensated. Non-compensated electromagnetic forces lead to strong melt circulations and big heavings of the metal, a significant decrease in the magnetohydrodynamic margin (MHD stability) of the cell and do not allow having high technical and economic indicators when increasing the amperage of the cell.

A busbar method is known for aluminum reduction cells longitudinally arranged in two-rows in the housing, which includes a two-sided current supply to the anode and in which the section of the ring stack on the side closest to the neighboring row is bigger and more collector bars are connected to it than to the ring stack on the opposite side of the cell.

In this case, the current distribution per riser is as follows: left input (along the movement of the current) riser—30-32%, right input riser—36-38%, left output riser 20-18%, and right output riser 12-14%. Cathode and ring buses on the side closest to the neighboring row of the cell are 30-50 cm higher than on the opposite side, i.e., closer to the layer of molten metal (USSR Inventor's Certificate No. 356312, C 22 d 3/12, 1972).

Using this prior art helps compensate for the influence of the magnetic field from the neighboring row of cells but does not provide an optimal configuration of the vertical magnetic field to reduce heaving of the metal pad and to enhance the MHD stability of the cell.

A busbar for an aluminum reduction cell is known, with cells longitudinally arranged in a housing, that contains collector bars connected to stacks of cathode buses located on the longitudinal sides of the cell, each of which has at least one cathode bus, input and output anode risers connected to stacks of cathode buses by means of connecting buses and anode buses by means of transmitting buses. On the input and output, the anode buses have input and output jumpers and an additional jumper. For applying the target current load to the anodes of the following cell, electrical resistance varies in the electrical circuits used to apply the current load. It can be a 4-riser busbar with two input risers located at the input end of the cell in the projection of the cathode two output risers located on the longitudinal sides at a distance from the central transverse axis of the cell, which is 0.05-0.16 of the length of the cell. The barbus is made with current distribution per riser as follows: left input riser—15-35%, right input riser—10-40%, left output riser—15-35%, right output riser—10-40% (RF Patent No. 2281989, C25C 3/16, 2006).

The invention allows optimizing, but not significantly, the electromagnetic characteristics of the process and the circulation rate of the metal and the bath but does not provide, to the full extent, high MHD stability of the cell; the busbar is quite large, difficult to install;

a significant number of connector assemblies leads to significant current losses (not related to the reduction process); and the outside-mounted anode risers make servicing the cell difficult.

A busbar is known for high-amperage aluminum reduction cells connected in series, that contains two risers located on the longitudinal sides of the cell, another two risers are located at the input end of the cathode shell of the cell, and two to-be-assembled cathode buses on each longitudinal side of the cell. The current from the collector bars of the cell, located on the side of the output end of the cathode shell, is transmitted with the help of the cathode buses to the risers located on the longitudinal sides of the following cell. The cathode buses that transmit the current from the collector bars of the cell on the side of the input end of the cathode shell are located along the longitudinal and transverse axes of the cell, beneath the cell. They are elevated up to the level of the metal at the output end of the cathode shell of the cell and connected to the risers located at the input end of the cathode shell of the following cell (RF Patent No. 2,282,681, C25C 7/06, 2006).

This known busbar provides optimal compensation for the magnetic field and high MHD stability of the cell, but the busbar itself is quite large, and the anode risers on the longitudinal sides of the cell make servicing the cell difficult.

A busbar is known for aluminum reduction cells longitudinally arranged in two-rows in the housing, that contains anode buses, risers, stacks of cathodes buses of groups of collector bars, of which the collector bars located closest to the output end of the cathode are connected to the risers located at the input end, and the remaining collector bars are connected to the risers located along the sides of the cathode shell of the following cell. The anode risers are connected to the anode bus at the points corresponding to 13 and 23 of its length; the stacks of cathode buses on the side farthest from the neighboring row of cells are below the stacks of cathode buses on the opposite side of the cell by 1.1-2.7 m; 17.6-20.6% of all the collector bars of the preceding cell are connected to the output end of the anode bus located on the side closest to the neighboring row of cells. Moreover, the ratio of the number of the collector bars connected to the input end of the anode bus located on the side farthest from the neighboring row of cells to those connected to the input end of the bus located on the opposite side of the cell is 1.14-1.7:1 (RF Patent No. 2,004,630, C 25 C 3/16, 1993).

This prior art, due to varied current distribution, symmetrically-located and outside-mounted risers, and different levels of position of the cathode busbar, helps improve the magnetohydrodynamic characteristics by compensating for an additional vertical component of the middle row of cells and a partial reduction and improved symmetry along the transverse component. However, no improvements are achieved in full, and they are achieved due to a significant increase in the amount of metal per structure and the complexity of design of the busbar, which is a very significant disadvantage. The anode risers on the longitudinal sides of the cell make servicing such cells difficult.

A device is known for supplying power to aluminum reduction cells connected in series in longitudinal arrangement in the housing that contains anode buses, collector bars and the risers, which are located at the input end and in the middle of the longitudinal sides of the cathode shell. Compensation for the field of the neighboring row of cells is performed by additional buses, which are located at the level of the stacks of cathode buses at the inner and outer sides of both rows of cells. The collector bars are divided into groups, each of which is connected to an individual stack of cathode buses (RF Patent No. 2,170,290, C25C 316, 2000).

A disadvantage of this known art is that it cannot be used for cells longitudinally arranged in the housing if the amperage of the cell is high (250 kA and higher) due to insufficient compensation for the magnetic field. The MHD stability of the cell at such significant amperage is ensured by strict requirements for the magnetic field configuration in the cell bath. Normal cell operation is difficult due to the location of the anode risers on the longitudinal sides of the cell.

A busbar is known for cells connected in series that contains two risers located in the middle of the longitudinal sides of the cell, another two risers located at the input end of the cathode shell of the cell. The current from the collector bars of the cell located at the input end of the cathode shell is transmitted with the help of cathode buses to the risers located on the longitudinal sides of the following cell. The cathode buses transmitting the current from the collector bars of the cell located on the side of the output end of the cathode shell are located along the longitudinal and transverse axes of the cell, below the cell. They are elevated at the output end of the cathode shell of the cell approximately up to the level of the metal and connected to the risers located at the input end of the cathode shell of the following cell (RF Patent No. 2,328,556, C25C 3/16, 2006). Compensation for the influence of the neighboring row of cells is performed by transmitting part of the current from the collector bars near the middle of the cell to the opposite side of the cell by the bus which runs underneath the cathode shell and is elevated approximately up to the mid-level of the metal and, then, goes back underneath the cathode shell to the middle riser of the following cell.

The disadvantage of this known art is that a high MHD stability margin is ensured by a large busbar design and the use of anode risers on the longitudinal sides of the cell.

The closest prior art to the proposed art, in terms of its technical essence and technical effect, is a busbar for high-amperage aluminum reduction cells longitudinally arranged in a housing, that contains anode buses, risers located at the input and output ends of the cathode shell, and collector bars divided into approximately equal groups, each of which is connected to individual collector bars; whereby the cathodes buses of the groups of collector bars closest to the input end of the cathode shell are connected to the risers located at the input end, and the remaining groups of collector bars are connected to the risers located at the output end of the cell (U.S. Pat. No. 4,132,621, C25C 3/16, 1979).

A disadvantage of the known prior art is that it cannot be used for cells longitudinally arranged and operating at a low anode-to-cathode distance (ACD) due to insufficient compensation for the magnetic field. The MHD stability of the cell at low ACDs is ensured by strict requirements for the magnetic field configuration in the cell bath. For suitable cell operation, it is necessary to maximally reduce the value of the vertical magnetic field.

The aim of the invention is to develop a cell busbar design providing higher cell productivity due to stable operation at low ACDs.

The technical result of the invention is to accomplish a high degree of compensation for the electric and magnetic forces in the melt by optimizing the magnetic field configuration in the cell bath and reducing the value of the vertical magnetic field.

The above aim is achieved in that, in the busbar for aluminum reduction cells longitudinally arranged in a housing, that contains anode buses, risers and collector bars divided into groups, each of which is connected to individual cathode buses, the cathode buses of the groups of collector bars closest to the input end of the preceding cell are connected to the risers located at the input end of the following cell, and the remaining groups of collector bars are connected to the risers at the output end of the following cell. According to the proposed solution, the cathode buses of the groups of collector bars closest to the input end of the preceding cell are located underneath the preceding cell, and the cathode buses of the remaining groups of collector bars are located underneath the preceding and following cells, or the preceding and following cells and along the cathode shell on the front side of the following cell. In this case, the risers located at the input end of the following cell are installed with an offset to the center of the cell relative to the risers located at the output end of the following cell.

The invention has a special distinctive feature.

The cathode bus along the cathode shell on the front side of the following cell provides for distributing 70-100% of the amperage, from the total amperage supplied to the risers located at the output end of the following cell.

A comparative analysis of the features of the claimed solution and the features of the prior art confirms that the solution complies with the criteria of "novelty" and "inventive step."

The essence of the invention is clarified with the following figures.

Figure 1:
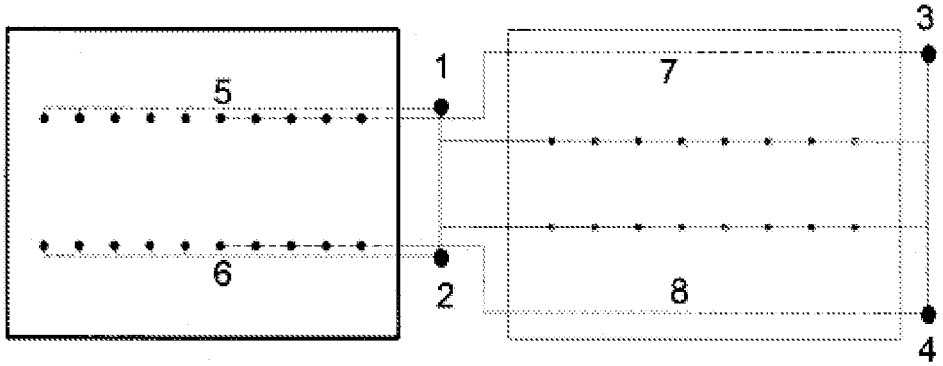
FIG. 1 shows a diagram of the busbar with cathode buses located underneath the preceding and following cells.
Figure 2:
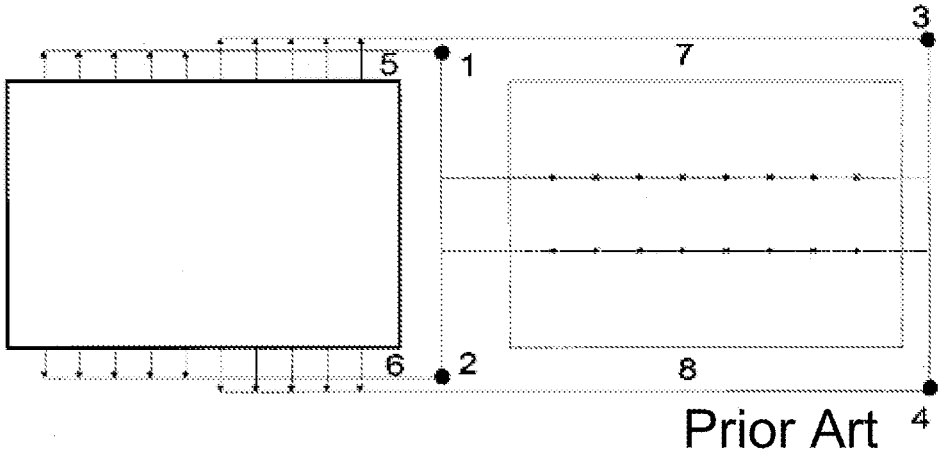
FIG. 2 shows a diagram of the busbar as per the prior art.
Figure 5:
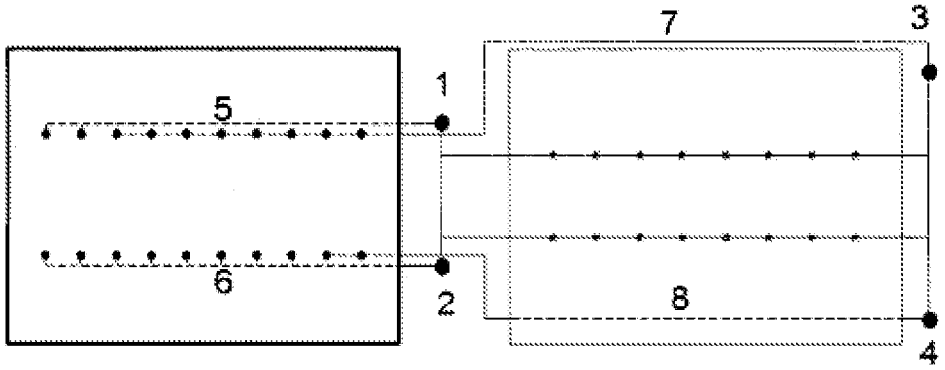
FIG. 5 shows a diagram of the busbar with cathode buses located underneath the preceding and following cells and along the cathode shell on the front side of the following cell.

The design of the cell busbar includes two risers 1 and 2 located at the input end of the cathode shell of the following cell symmetrically with respect to its middle and two risers 3 and 4 symmetrically located at the output end of the cathode shell of the following cell. For the prior art (see FIG. 2), part of the collector bars located on the side of the input end is connected with the help of cathode buses 5 and 6 to risers 1 and 2. Cathode buses 7 and 8 transmit the current from the collector bars of the cell on the side of the output end of the cathode shell to risers 3 and 4. The claimed busbar (FIG. 1, 5) is characterized by cathode current collection underneath the cell. Part of the collector bars located on the side of the input end is connected with the help of cathode buses 5 and 6 to risers 1 and 2 and located underneath the cell. Cathode buses 7 and 8 are located underneath two cells and transmit the current from the collector bars of the cell on the side of the output end of the cathode shell to risers 3 and 4. It is possible to have the cathode bus on the front side of the cell, not underneath the following cell but along the side of the cathode shell of the following cell, on the front side. Transmission of a higher current to the cathode bus on the front side of the following cell, rather than to the cathode bus on the back side of the cell, compensates for the magnetic field of the neighboring row of cells (FIG. 5). In the limiting case, when 100% of the current is transmitted through said bus, we have a 3-riser busbar: two risers at the input end of the cell and one riser is at the output end.

High MHD stability is related to the minimization of the vertical magnetic field in the cell bath. An increase in the process parameters of the cell is achieved due to stable cell operation at lower ACDs.

Figure 3:
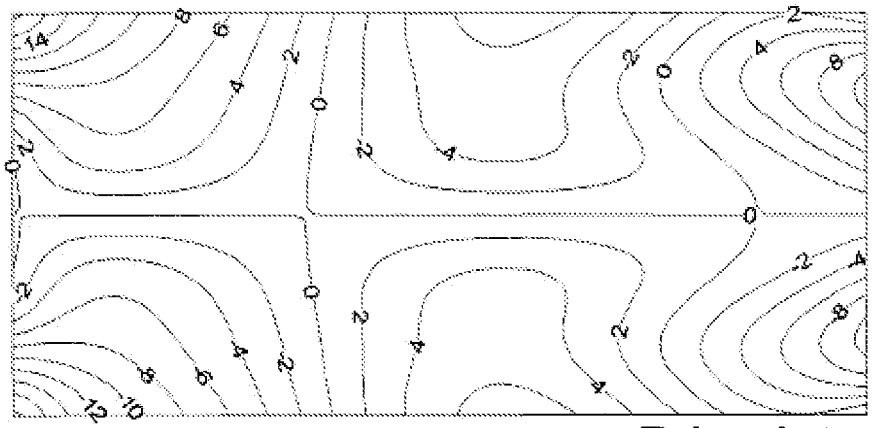
FIG. 3 shows a vertical component of the induction of the magnetic field (in gauss) for a 150 kA cell as per the prior art.
Figure 4:
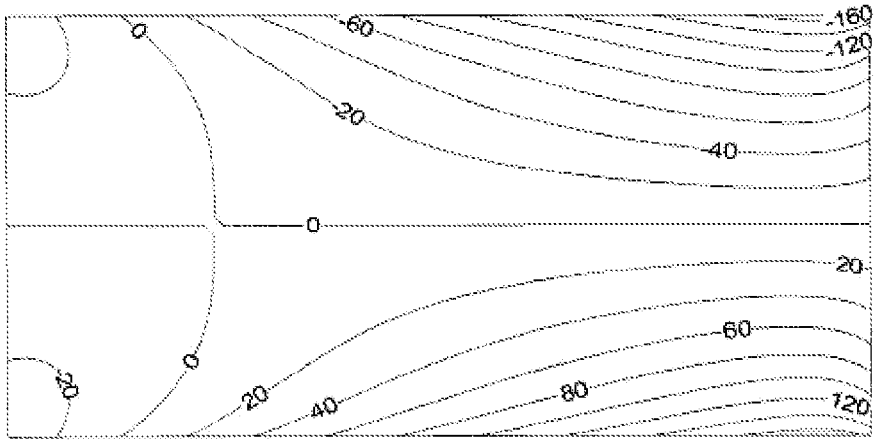
FIG. 4 shows a vertical component of the induction of the magnetic field (in gauss) for a cell as per the claimed busbar.

The effect of the proposed technical solution is displayed in FIG. 4, which shows the lines of the vertical magnetic field in the layer of molten metal. Comparison with FIG. 3 (the magnetic field as per the prior art) shows that, when the current is supplied according to said busbar diagram, including running the current underneath the cell, it results in a significant decrease in the value of the vertical magnetic field. As detailed numerical calculations regarding MHD stability show, the new busbar provides significantly higher MHD stability of the cell.

The invention claimed is:

1. A busbar system for aluminum reduction cells, the system comprising:

a preceding reduction cell, the preceding cell being longitudinally arranged in a housing adjacent to a following reduction cell, the preceding cell and following cell each comprising an input end and an output end and each having a front side;

a plurality of anode buses, a first group and a second group of risers, and a first and a second group of collector bars, the first group of collector bars being connected to a first group of cathode buses, and the second group of collector bars being connected to a second group of cathode buses;

wherein the first group of collector bars is closer to the input end of the preceding cell than the second group of collector bars;

wherein the first group of risers is located at the input end of the following cell and the second group of risers is located at the output end of the following cell;

wherein the first group of cathode buses is located underneath the preceding cell and is connected to the first group of risers;

wherein the second group of cathode buses is located underneath the preceding cell and following cell and is connected to the second group of risers; and wherein the first group of risers are installed with an offset to the center of the cell relative to the second group of risers.

2. The busbar system as per claim 1, wherein the following cell further comprises a cathode shell, wherein one of the second group of cathode buses is situated along the cathode shell on the front side of the following cell and the one of the second group of cathode buses provides for distributing 70-100% of the amperage from the total amperage supplied to the risers located at the output end of the following cell.

3. The busbar system as per claim 1, further comprising a cathode shell situated on the front side of the following cell, wherein one of second group of cathode buses is located along the cathode shell.

* * * * *